US011505762B2

(12) United States Patent
Greaves

(10) Patent No.: US 11,505,762 B2
(45) Date of Patent: Nov. 22, 2022

(54) HYDRAULIC FLUIDS HAVING BIODEGRADABLE POLYALKYLENE GLYCOL RHEOLOGY MODIFIERS USEFUL IN SUBSEA APPLICATIONS

(71) Applicant: DOW GLOBAL TECHNOLOGIES LLC, Midland, MI (US)

(72) Inventor: Martin R. Greaves, Horgen (CH)

(73) Assignee: DOW GLOBAL TECHNOLOGIES LLC, Midland, MI (US)

( * ) Notice: Subject to any disclaimer, the term of this patent is extended or adjusted under 35 U.S.C. 154(b) by 0 days.

(21) Appl. No.: 17/281,651

(22) PCT Filed: Oct. 3, 2019

(86) PCT No.: PCT/US2019/054389

§ 371 (c)(1),
(2) Date: Mar. 31, 2021

(87) PCT Pub. No.: WO2020/086229

PCT Pub. Date: Apr. 30, 2020

(65) Prior Publication Data

US 2021/0371768 A1 Dec. 2, 2021

Related U.S. Application Data

(60) Provisional application No. 62/750,871, filed on Oct. 26, 2018.

(51) Int. Cl.

| | |
|---|---|
| ***C10M 173/02*** | (2006.01) |
| ***C10N 20/00*** | (2006.01) |
| ***C10N 20/04*** | (2006.01) |
| ***C10N 30/02*** | (2006.01) |
| ***C10N 40/08*** | (2006.01) |

(52) U.S. Cl.

CPC .. *C10M 173/02* (2013.01); *C10M 2207/0225* (2013.01); *C10M 2209/1036* (2013.01); *C10M 2209/1075* (2013.01); *C10N 2020/04* (2013.01); *C10N 2020/081* (2020.05); *C10N 2030/02* (2013.01); *C10N 2040/08* (2013.01)

(58) Field of Classification Search

CPC ..... C10M 173/02; C10M 2207/0225; C10M 2209/1036; C10M 2209/1075; C10N 2020/04; C10N 2020/081; C10N 2030/02; C10N 2040/08

See application file for complete search history.

(56) References Cited

U.S. PATENT DOCUMENTS

| | | | | |
|---|---|---|---|---|
| 5,648,557 | A * | 7/1997 | Wei | C08G 65/331 568/617 |
| 7,456,138 | B2 * | 11/2008 | Sherman | C10M 107/34 508/579 |
| 2010/0016186 | A1 | 1/2010 | Smith | |
| 2012/0040875 | A1 | 2/2012 | Kupfer et al. | |

FOREIGN PATENT DOCUMENTS

| | | | | |
|---|---|---|---|---|
| CN | 102660365 | A | 9/2012 | |
| JP | H04136097 | A | 5/1992 | |
| WO | 2005113640 | A1 | 12/2005 | |
| WO | 2008089130 | A1 | 7/2008 | |
| WO | 2009012058 | A2 | 1/2009 | |
| WO | WO-2018057730 | A1 * | 3/2018 | C10M 107/34 |

OTHER PUBLICATIONS

"DOWFAX Nonionic Surfactants", Dow Polyglycols, Mar. 2000; 8 pages.

International Preliminary Report on Patentability for the corresponding International Application No. PCT/US2019/054389, International Filing Date: Oct. 3, 2019, dated Oct. 26, 2018; 17 pages.

International Search Report for the corresponding International Application No. PCT/US2019/054389, International Filing Date: Oct. 3, 2019; dated Mar. 10, 2020; 8 pages.

Written Opinion for the corresponding International Application No. PCT/US2019/054389, International Filing Date: Oct. 3, 2019; dated Mar. 10, 2020; 11 pages.

* cited by examiner

*Primary Examiner* — James C Goloboy
(74) *Attorney, Agent, or Firm* — Cantor Colburn LLP

(57) ABSTRACT

A composition comprising water, a glycol, and a polyalkylene glycol which has a biodegradability of at least 60% as determined using OECD 301F wherein the composition has a kinematic viscosity of at least 25 $mm^2$/sec at 40° C. is useful as a rheology modifier, particularly in subsea applications. In some instances, the composition comprises 10 to 65 weight % water, 20 to 60 weight % of a glycol selected from ethylene glycol, diethylene glycol, triethylene glycol and tetra ethylene glycol, 10 to 40 weight % of a polyalkylene glycol, and 0 to 10% of additives based on total weight of the composition wherein the polyalkylene glycol has a—molecular weight of no more than 4000 g/mol and is characterized in that it is an oxyethylene/oxypropylene block copolymer having a weight percent of oxyethylene of at least 20% based on total weight of the copolymer.

19 Claims, No Drawings

HYDRAULIC FLUIDS HAVING BIODEGRADABLE POLYALKYLENE GLYCOL RHEOLOGY MODIFIERS USEFUL IN SUBSEA APPLICATIONS

CROSS-REFERENCE TO RELATED APPLICATIONS

This application is a National Stage application of PCT/US2019/054389, filed Oct. 3, 2019, which claims benefit of Provisional Application No 62/750,871 filed on Oct. 26, 2018, both of which are incorporated by reference herein in their entirety.

FIELD OF THE INVENTION

The field of this invention is a hydraulic fluid composition having a biodegradable polyalkylene glycol.

BACKGROUND

In the oil and gas industry subsea hydraulic fluids are used to control the flow of oil deep underwater. Occasionally these fluids are leaked or released into the ocean. Therefore, it is desirable to have biodegradable hydraulic fluids.

Many hydraulic fluids used in equipment contain water, a glycol and a relatively high molecular weight polyalkylene glycol (PAG) as a thickener or rheology modifier. These three components typically represent more than 90% by weight of a hydraulic fluid composition and it is desirable that each of these components offers a high degree of biodegradability so that the final formulation offers a high degree of biodegradability. The glycols used can be, for example, ethylene glycol, diethylene glycol, and propylene glycol and are readily biodegradable. The PAGs are typically random copolymers of ethylene oxide (EO) and propylene oxide (PO) (typically 1,2-propylene oxide) having molecular weights of about 12,000 g/mol or higher. These high molecular weight PAGs do not have the desired degree of biodegradability and have very low biodegradability Lower molecular weight PAGs are known to be more biodegradable but do not have sufficient thickening efficiency in a water/glycol base fluid for the desired applications.

Thus, it is desired to have a hydraulic fluid composition which has a high degree of biodegradability while also maintaining the desired rheology properties for the fluid. Moreover it would be preferable to include a biodegradable polyalkylene glycol at a treat level of less than 30% by weight of the total weight of the composition to help keep the formulation costs low.

SUMMARY OF THE INVENTION

Disclosed herein is a composition comprising 10 to 65 weight % water, 20 to 60 weight % of a glycol selected from ethylene glycol, diethylene glycol, triethylene glycol and tetra ethylene glycol, 10 to 40 weight % of a polyalkylene glycol, and 0 to 10% of additives based on total weight of the composition wherein the polyalkylene glycol has a—molecular weight of no more than 4000 g/mol and is characterized in that it is an oxyethylene/oxypropylene block copolymer having a weight percent of oxyethylene of at least 20% based on total weight of the copolymer.

Also disclosed herein is a composition comprising water, a glycol, and a polyalkylene glycol having a biodegradability of at least 60% as determined using OECD 301F wherein the composition has a kinematic viscosity of at least 25 $mm^2$/sec at 40° C.

The compositions disclosed herein may be used in hydraulic fluids, particularly for subsea applications.

DETAILED DESCRIPTION OF THE INVENTION

The composition disclosed herein comprises a polyalkylene glycol, a glycol and water.

The polyalkylene glycol is characterized in that it is biodegradable. Specifically, the biodegradability when measured using OECD 301F is at least 60%, or at least 70% or at least 80% or at least 90%.

According to an embodiment, the polyalkylene glycol has a molecular weight of no more than 4000 g/mol, or no more than 3500 g/mol, or no more than 3000 g/mol but at least 1000 g/mol, or at least 1500 g/mol, or at least 2000 g/mol as measured by ASTM D4274.

The polyalkylene glycol is characterized in that it is a block copolymer of ethylene oxide and propylene oxide (especially 1,2-propylene oxide). The block formed from ethylene oxide is also referred to herein as oxyethylene or the oxyethylene block. The block formed from the propylene oxide is also referred to herein as oxypropylene or the oxypropylene block. The weight percent of ethylene oxide is greater than 20% or greater than 25% based on total weight of ethylene oxide and propylene oxide used in making the polyalkylene glycol. According to one embodiment, the weight percent of ethylene oxide is no greater than 45%, or no greater than 40% or no greater than 38%. The block copolymer may be linear or branched.

In certain embodiments, the block copolymer may have an AB structure or an ABA structure or a BAB structure, where A is an oxyethylene based block and B is a oxypropylene based block. A linear AB structure is formed when a monol initiator is used. A monol initiator has only one hydroxyl group in the structure which is the site for alkoxylation to synthesize the block copolymer. The initiator may be for example ROH where R is an alkyl group. Butanol is an example of a monol initiator. For example, 1,2-propylene oxide is reacted on to the initiator to make an oxypropylene block (B). Thereafter ethylene oxide is added to synthesize a block of oxyethylene (A) and the final polymer has an AB structure. A linear ABA or BAB structure is formed when a diol initiator is used. A diol initiator has two hydroxyl groups in the structure which are the sites for alkoxylation to synthesize the block copolymer. 1,2-propylene glycol is an example of a diol initiator. For example, 1,2-propylene oxide is reacted on to the initiator to make an oxypropylene block (B). Thereafter ethylene oxide is added to synthesize two blocks of oxyethylene (A). This gives a polymer with an ABA structure. A branched structure is formed when a triol initiator is used. Glycerol is an example of a triol initiator.

According to certain embodiments, the structure is EO block-PO block-EO block (ABA), or PO block-EO block-PO block, or EO block-PO block. A linear AB or ABAstructure may be represented by formula I

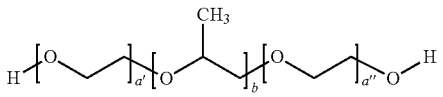

wherein a' and a" are independently in each occurrence an integer of 0 to 20 provided that a'+a" is at least 5 and no more than 40, and b is an integer of from 15 to 40.

According to certain embodiments, the amount of the polyalkylene glycol is at least 5%, or at least 10%, or at least 15% by weight based on total weight of the composition. According to certain embodiments the amount of polyalkylene glycol is no more than 35%, or no more than 30% or no more than 25% by weight based on total weight of the composition.

The glycol may be any glycol known for use in hydraulic fluids. Examples of such glycols are ethylene glycol, diethylene glycol, triethylene glycol, tetraethylene glycol and 1,2-propylene glycol. Mixtures of glycols may also be used. According to one embodiment the glycol is ethylene glycol or diethylene glycol. In fact use of the polyalkylene glycol block copolymers (especially an EO block-PO block-EO block PAG, i.e. EO-PO-EO PAG) with ethylene glycol or diethylene glycol shows an unexpected synergistic effect on increasing the viscosity as noted in Example 3 below.

The amount of the glycol according to certain embodiments is at least 20% or at least 30% by weight based on total weight of the composition. The amount of glycol according to certain embodiments is no more than 60% or no more than 50% by weight based on total weight of the composition.

A third component of the composition is water. According to certain embodiments the amount of water is at least 10%, or at least 15% or at least 25% or at least 30% by weight based on total weight of the composition. According to certain embodiments, the amount of water is no more than 60% or no more than 55% or no more than 50% by weight based on total weight of the composition. When an EO-PO-EO PAG is used having from 25 to about 35 weight % oxyethylene based repeat units, the amount of water is beneficially 30-50% by weight. When an EO-PO-EO PAG having 35 to about 45 or 40 weight % oxyethylene based repeat units is used, the amount of water is beneficially 10-30% by weight.

An optional fourth component of the composition is an additive package. The additive package may have one or more additives selected from corrosion inhibitors (e.g. ferrous or vapor phase), lubricity aids, anti-foaming agents, air release additives anti-microbials, and dyes. The cumulative amount of the additives according to an embodiment is no more than 10% by weight based on total weight of the composition.

The composition according to certain embodiments meets one of ISO-32, 46 and 68 viscosity grades (ISO is International Standards Organization) and therefore has typical kinematic viscosities at 40° C. of about 32, 46 and 68 $mm^2$/sec (cSt) respectively. The composition according to certain embodiments has a kinematic viscosity at 40° C. greater than 25 $mm^2$/sec as measured by ASTM D7042.

Examples

Example 1—Assessment of Biodegradability

Various polyalkylene glycols were evaluated for their biodegradability according to OECD301F. The properties of ethylene oxide (EO) content (weight % based on consitutent monomer components of the PAG), molecular weight by hydroxyl number measurement ASTM D4274, kinematic viscosity as determined by ASTM D7042, the type initiator used to form the PAG, the structure of the PAG, as well as the biodegradability are set out in Table 1. Higher molecular weight polymers, random structures and block structures with a low oxyethylene content showed lower biodegradability. The Dowfax™ products are block copolymers of ethylene oxide and 1,2 propylene oxide (unless EO content is specified at 0% in which case it is a homopolymer) and UCON™ products are random copolymers of ethylene oxide and 1,2 propylene oxide both from The Dow Chemical Company. Synalox™ 40-D700 is a random copolymer of ethylene oxide and 1,2 propylene oxide from The Dow Chemical Company. The PAGs made with the triol initiator are branched. The PAGs prepared from a monol intiator are linear di-blocks, The PAGs made with the diol initiator are linear tri-blocks.

TABLE 1

| Polyakylkene glycol name | EO Content, % | Actual Mol. weight (Da) | Kinematic viscosity, 25° C., $mm^2$/sec. | Initiator | Biodegradability, % OECD301F |
|---|---|---|---|---|---|
| Dowfax ™ 63N13 | 16 | 2100 | 300 | DIOL | 95 |
| Dowfax ™ 63N20 | 20 | 2200 | 340 | DIOL | n.d.* |
| Dowfax ™ 63N30 | 30 | 2500 | 440 | DIOL | 92 |
| Dowfax ™ 63N37 | 37 | 2750 | 560 | DIOL | n.d.* |
| Dowfax ™ 63N40 | 40 | 2900 | 590 | DIOL | 99 |
| Dowfax ™ 81N13 | 13 | 2700 | 475 | DIOL | 79 |
| Dowfax ™ DF-111 | 13 | 3800 | 790 | TRIOL | 62 |
| Dowfax ™ DF-114 | 0 | 3500 | 810 | TRIOL | 33 |
| Dowfax ™ DF-142 | 22 | 1500 | 190 | MONOL | 66 |
| SYNALOX ™ 40-D700 | 60 | 5000 | n/d | DIOL | 18 |
| UCON ™ 75-H-90000 | 75 | 12,000 | n/d | DIOL | 8 |

*n.d. was not actually determined but based on similar products Dowfax ™ 63N13, 63N30, and 63N40 biodegradability is expected to be higher than 90%.

Example 2—Assessment of Solubility and Thickening Efficiency

A base oil is prepared having diethylene glycol and deionized water at 40/60 weight ratios. The base oil is prepared by mixing at room temperature. The base has a kinematic viscosity as measure by ASTM D7042 of 1.9 $mm^2$/sec at 40° C. and 3.19 $mm^2$/sec at 23° C. To the base oil is added PAG and the mixture stirred at 50° C. for 10 minutes and allowed to cool to room temperature. The thickening efficiency of each PAG was assessed at treat levels of 10, 15, 20 and 25% (by weight) by measuring the kinematic viscosity of each composition using ASTM D7042. It is desired to achieve a kinematic viscosity (40° C.) of 25 $mm^2$/sec or higher with 25% or less of PAG. Blends which are clear at each temperature are highly preferred. Blends which are not homogeneous (form two phases) are not useful. Blends which are turbid (but not two phases) are considered useful.

The results are shown in the following Tables. Dowfax™ 63N13, 63N20, 63N30 and 63N40 all belong to the same polymer (ABA triblock) family (structure shown in formula 1) in which the polypropylene glycol block has the same molecular weight (1750 g/mol) but their molecular weights differ due to their different oxyethylene contents.

TABLE 2a

Thickening Efficiency of Dowfax ™ 63N13 in Base Oil

| | Sample 2.a.1 | Sample 2.a.2 | Sample 2.a.3 | Sample 2.a.4 |
|---|---|---|---|---|
| Base Oil (weight %) | 75 | 80 | 85 | 90 |
| Dowfax ™ 63N13 (weight %) | 25 | 20 | 15 | 10 |
| Viscosity at 40° C., $mm^2$/sec | n/d | n/d | n/d | n/d |
| Appearance at room temp after 1 day | turbid, 2-phases | turbid, 2-phases | turbid, 2-phases | turbid, 2-phases |

n/d = not determined.

Since the product was unstable at room temperature no further work at other temperatures was undertaken. The solubility of Dowfax™ 63N13 was poor. This is believed to be due to the low oxyethylene content (16%) in the PAG.

TABLE 2b

Thickening Efficiency of Dowfax ™ 63N20 in Base Oil

| | Sample 2.b.1 | Sample 2.b.2 | Sample 2.b.3 | Sample 2.b.4 |
|---|---|---|---|---|
| Base Oil (weight %) | 75 | 80 | 85 | 90 |
| Dowfax ™ 63N20 (weight %) | 25 | 20 | 15 | 10 |
| Viscosity at 40° C., $mm^2$/sec | n/d | n/d | n/d | n/d |
| Appearance at room temp after 1 day | turbid, 2-phases | turbid, 2-phases | turbid, 2-phases | turbid, 2-phases |

Similarly the solubility of Dowfax™ 63N20 in the base was poor and is believed to be due to the low oxyethylene content (20%) in the PAG.

TABLE 2c

Thickening Efficiency of Dowfax ™ 63N30 in Base Oil

| | Sample 2.c.1 | Sample 2.c.2 | Sample 2.c.3 | Sample 2.c.4 |
|---|---|---|---|---|
| Base Oil (weight %) | 75 | 80 | 85 | 90 |
| Dowfax ™ 63N30 (weight %) | 25 | 20 | 15 | 10 |
| Viscosity at 40° C., $mm^2$/sec | 80.1 | 52.9 | 31 | 16.3 |
| Appearance at room temp after 1 day | clear | clear | clear | clear |
| Appearance at room temp after 7 days | clear | clear | clear | clear |
| Appearance at 0° C. after 7 days | clear | clear | clear | clear |
| Appearance at 50° C. after 7 days | turbid, 2-phase* | turbid, 2-phase* | turbid | turbid |

*On cooling to room temperature (23° C.) the product had a clear homogeneous appearance.

The solubility of Dowfax™ 63N30 in the base was good at room temperature and at low temperature. This is believed to be due to the higher oxyethylene content (30%) in the PAG versus Dowfax™ 63N13 and 63N20 which are of the same polymer family but lower molecular weights. At 50° C. the product separates into two phases at its cloud point but returns to a homogeneous phase on cooling. It shows excellent thickening efficiency. Only 15% of PAG in the composition created an ISO-32 viscosity grade fluid (32 $mm^2$/sec at 40° C.).

TABLE 2d

| Thickening Efficiency of Dowfax ™ 63N37 in Base Oil | | | | |
|---|---|---|---|---|
| | Sample 2.d.1 | Sample 2.d.2 | Sample 2.d.3 | Sample 2.d.4 |
| Base Oil (weight %) | 75 | 80 | 85 | 90 |
| Dowfax ™ 63N37 (weight %) | 25 | 20 | 15 | 10 |
| Viscosity at 40° C., $mm^2$/sec | 61.0 | 23.1 | 9.7 | 4.6 |
| Appearance at room temp after 1 day | clear | clear | clear | clear |
| Appearance at room temp after 7 days | clear | clear | clear | clear |
| Appearance at 0° C. after 7 days | clear | clear | clear | clear |
| Appearance at 50° C. after 7 days | clear | 2-phases | 2-phases | 2-phases |

The solubility of Dowfax™ 63N37 in the base was excellent at ambient and low temperatures. Its thickening efficiency was good but required 25% to achieve a viscosity greater than 25 $mm^2$/sec.

TABLE 2e

| Thickening Efficiency of Dowfax 63N40 in Base Oil | | | | |
|---|---|---|---|---|
| | Sample 2.e1 | Sample 2.e.2 | Sample 2.e.3 | Sample 2.e.4 |
| Base Oil (weight %) | 75 | 80 | 85 | 90 |
| Dowfax ™ 63N40 (weight %) | 25 | 20 | 15 | 10 |
| Viscosity at 40° C., $mm^2$/sec | 23.9 | 12.3 | 6.7 | 4.1 |
| Appearance at room temp after 1 day | clear | clear | clear | clear |
| Appearance at room temp after 7 days | clear | clear | clear | clear |
| Appearance at 0° C. after 7 days | clear | clear | clear | clear |
| Appearance at 50° C. after 7 days | clear | clear | clear | clear |

The solubility of Dowfax™ 63N40 in the base was excellent at all temperatures. However its thickening efficiency was low and more of the PAG is required to get near the desired viscosity target of at least 25 $mm^2$/sec.

TABLE 2f

| Thickening Efficiency of Dowfax ™ 81N13 in Base Oil | | | | |
|---|---|---|---|---|
| | Sample 2.f.1 | Sample 2.f.2 | Sample 2.f.3 | Sample 2.f.4 |
| Base Oil (weight %) | 75 | 80 | 85 | 90 |
| Dowfax ™ 81N13 (weight %) | 25 | 20 | 15 | 10 |
| Viscosity at 40° C., $mm^2$/sec | n/d | n/d | n/d | n/d |
| Appearance at room temp after 1 day | white, 2-phases | white, 2-phases | white, 2-phases | white, 2-phases |

The solubility of Dowfax™ 81N13 in the base was poor and is believed to be due to the low oxyethylene content (13%) in the PAG. This PAG is chemically similar to Dowfax™ 63N13 but with a higher molecular weight due to the polypropylene glycol core being a higher molecular weight than in Dowfax™ 63N13.

TABLE 2g

| Thickening Efficiency of Dowfax ™ DF-114 in Base Oil | | | | |
|---|---|---|---|---|
| | Sample 2.g.1 | Sample 2.g.2 | Sample 2.g.3 | Sample 2.g.4 |
| Base Oil (weight %) | 75 | 80 | 85 | 90 |
| Dowfax ™ DF-114 (weight %) | 25 | 20 | 15 | 10 |
| Viscosity at 40° C., $mm^2$/sec | n/d | n/d | n/d | n/d |
| Appearance at room temp after 1 day | turbid 2-phases | clear 2-phases | clear 2-phases | clear 2-phases |

The solubility of Dowfax™ DF-114 in the base oil was poor. This is because it is a PO homo-polymer (Triol). It also has poor biodegradability.

TABLE 2h

Thickening Efficiency of random EO/PO copolymers in base oil

| | Sample 2.h.1 | Sample 2.h.2 | Sample 2.h.3 | Sample 2.h.4 | Sample 2.h.5 |
|---|---|---|---|---|---|
| Base Oil (weight %) | 90 | 85 | 80 | 75 | 75 |
| UCON ™ 75H-90,000 (wt. %) | 10 | 15 | 20 | 25 | — |
| SYNALOX ™ 40-D700 (wt. %) | — | — | — | — | 25 |
| Viscosity at 40° C., $mm^2$/sec | 13 | 25.3 | 46.3 | 83 | 23.2 |
| Appearance at room temp initial | clear | clear | clear | clear | clear |
| Appearance at room temp after 1 day | clear | clear | clear | clear | clear |
| Appearance at room temp after 7 days | clear | clear | clear | clear | clear |
| Appearance at 0° C. after 7 days | clear | clear | clear | clear | clear |
| Appearance at 50° C. after 7 days | clear | clear | clear | clear | clear |

While UCON™ 75-H-90,000, a high molecular weight random structure PAG of ethylene oxide and 1,2-propylene oxide shows good solubility and adequate thickening at amounts of 15% or more, UCON™ 75-H-90,000 is not biodegradable. At a 15% treat level a viscosity of 25 $mm^2$/sec is achieved. SYNALOX™ 40-D700 is a lower molecular weight random copolymer (MW=5000 g/mol) and is also not biodegradable. Even at a concentration of 25% its thickening efficiency does not reach the desired 25 $mm^2$/sec.

Example 3—Assessment of Base Oil Composition

Different based oil compositions were prepared using ethylene glycol/water, diethylene glycol water, and 1,2-propylene glycol/water in different water ratios. The base oil and fluid compositions are prepared and tested substantially as in Example 2.

TABLE 3a

Thickening efficiency of Dowfax ™ 63N30 in diethylene glycol/water base oils

| | 3A1 | 3A2 | 3A3 | 3A4 | 3A5 | 3A6 | 3A7 |
|---|---|---|---|---|---|---|---|
| Dowfax ™ 63N30 (weight %) | 15 | 15 | 15 | 15 | 15 | 15 | 15 |
| Diethylene glycol (DEG) (weight %) | 15 | 25 | 35 | 45 | 55 | 65 | 75 |
| Water (deionized) (weight %) | 70 | 60 | 50 | 40 | 30 | 20 | 10 |
| Viscosity at 40° C., $mm^2$/sec | 16.7 | 20 | 30.1 | 39 | 16.7 | n/d | n/d |
| Appearance at room temp initial | clear | clear | clear | clear | clear | turbid | turbid |
| Appearance at room temp after 1 day | clear | clear | clear | clear | clear | 2-phases | 2-phases |
| Appearance at room temp after 7 days | clear | clear | clear | clear | clear | 2-phases | 2-phases |
| Appearance at 0° C. after 7 days | clear | turbid | clear | clear | clear | 2-phases | 2-phases |
| Appearance at 50° C. after 7 days | turbid | turbid | turbid | sl. turbid | 2-phases | 2-phases | 2-phases |

Table 3a shows the effect of different concentrations of water in diethylene glycol when the Dowfax™ 63N30 is at 15%. The optimum concentration of water is 40 and 50% and in practice these are the preferred levels for use in a hydraulic systems. At low water levels (10 and 20%) the fluids were too unstable (phase separation) to obtain accurate viscosity measurements.

TABLE 3b

| Thickening efficiency of Dowfax ™ 63N30 in Mono-ethylene glycol | | | | | | | |
|---|---|---|---|---|---|---|---|
| | 3B1 | 3B2 | 3B3 | 3B4 | 3B5 | 3B6 | 3B7 |
| Dowfax ™ 63N30 (weight %) | 15 | 15 | 15 | 15 | 15 | 15 | 15 |
| Monoethylene glycol (MEG) (weight %) | 15 | 25 | 35 | 45 | 55 | 65 | 75 |
| Water (deionized) (weight %) | 70 | 60 | 50 | 40 | 30 | 20 | 10 |
| Viscosity at 40° C., $mm^2/sec$ | 12.5 | 21.3 | 29.4 | 35.7 | 34.6 | cannot measure | cannot measure |
| Appearance at room temp initial | clear | clear | clear | clear | clear | turbid | turbid |
| Appearance at room temp after 1 day | clear | clear | clear | clear | clear | v. sl. turbid | 2-phases |
| Appearance at room temp after 7 days | clear | clear | clear | clear | clear | v. sl. turbid | 2-phases |
| Appearance at 0° C. after 7 days | clear | clear | clear | clear | clear | clear | 2-phases |
| Appearance at 50° C. after 7 days | turbid | turbid | turbid | sl. turbid | 2-phases | 2-phases | 2-phases |

Table 3b shows the effect of different concentrations of water in ethylene glycol when the Dowfax™ 63N30 is at 15%. The optimum concentration of water is 30-50%. At low water levels (10 and 20%) the fluids were too unstable to obtain accurate viscosity measurements.

TABLE 3c

| Thickening efficiency of Dowfax ™ 63N30 in mono-propylene glycol | | | | | | | |
|---|---|---|---|---|---|---|---|
| | 3C1 | 3C2 | 3C3 | 3C4 | 3C5 | 3C6 | 3C7 |
| Dowfax ™ 63N30 (weight %) | 15 | 15 | 15 | 15 | 15 | 15 | 15 |
| Monopropylene (1,2-propylene glycol) (weight %) | 15 | 25 | 35 | 45 | 55 | 65 | 75 |
| Water (Weight %) | 70 | 60 | 50 | 40 | 30 | 20 | 10 |
| Viscosity at 40° C., $mm^2/sec$ | 4.8 | 5.4 | 6.7 | 8.8 | 11.3 | 15.2 | 21.5 |
| Appearance at room temp initial | clear | clear | clear | clear | clear | clear | clear |
| Appearance at room temp after 1 day | clear | clear | clear | clear | clear | clear | clear |
| Appearance at room temp after 7 days | clear | clear | clear | clear | clear | clear | clear |
| Appearance at 0° C. after 7 days | clear | clear | clear | clear | clear | clear | clear |
| Appearance at 50° C. after 7 days | v. sl. turbid | clear | clear | clear | clear | clear | clear |

Table 3c shows the effect of different concentrations of water in 1,2-propylene glycol when the Dowfax™ 63N30 is at 15%. Although the fluids were clear and homogeneous, the thickening efficiency of Dowfax™ 63N30 in this base oil is low. Thus, it appears there is some synergy between the base oil and the PAG when ethylene glycol or diethylene glycol are used.

TABLE 3d

| Thickening efficiency of Dowfax ™ 63N37 in diethylene glycol | | | | | | | |
|---|---|---|---|---|---|---|---|
| | 3D1 | 3d2 | 3D3 | 3D4 | 3D5 | 3D6 | 3D7 |
| Dowfax ™ 63N37 (weight %) | 15 | 15 | 15 | 15 | 15 | 15 | 15 |
| Diethylene glycol (DEG) (Weight %) | 15 | 25 | 35 | 45 | 55 | 65 | 75 |
| Water (deionized) (Weight %) | 70 | 60 | 50 | 40 | 30 | 20 | 10 |

TABLE 3d-continued

| Thickening efficiency of Dowfax ™ 63N37 in diethylene glycol | | | | | | | |
|---|---|---|---|---|---|---|---|
| | 3D1 | 3d2 | 3D3 | 3D4 | 3D5 | 3D6 | 3D7 |
| Viscosity at 40° C., $mm^2$/sec | 4.1 | 6.2 | 14.1 | 16.7 | 25.7 | 37.7 | 33.8 |
| Appearance at room temp initial | clear | clear | clear | clear | clear | clear | clear |
| Appearance at room temp after 1 day | clear | clear | clear | clear | clear | clear | clear |
| Appearance at room temp after 7 days | clear | clear | clear | clear | clear | clear | clear |
| Appearance at 0° C. after 7 days | clear | clear | clear | clear | clear | clear | clear |
| Appearance at 50° C. after 7 days | 2-phases | clear | clear | 2-phases | 2-phases | 2-phases | 2-phases |

Table 3d expands on the data from Table 3a in that a higher oxyethylene content (37%) triblock (Dowfax™ 63N37) is assessed. Compositions which contain 10-30% water provide good thickening efficiency.

What is claimed is:

1. A composition comprising 10 to 65 weight % water, 20 to 60 weight % of a glycol selected from ethylene glycol, diethylene glycol, triethylene glycol, tetratethylene glycol and combinations thereof, 5 to 25 weight % of a polyalkylene glycol, and 0 to 10% of additives based on total weight of the composition wherein the polyalkylene glycol has a biodegradability of at least 60% as determined using OECD 301F and a—molecular weight as determined by ASTMD4274 of no more than 4000 g/mol and is characterized in that it is an oxyethylene/oxypropylene block copolymer having a weight percent of oxyethylene of at least 25% based on total weight of the copolymer wherein the composition has a kinematic viscosity of at least 25 $mm^2$/second at 40° C. wherein the composition is a hydraulic fluid.

2. A composition comprising 10 to 65 weight % water, 20 to 60 weight % of a glycol, and 5 to 25% of a polyalkylene glycol based on total weight of the composition wherein the polyalkylene glycol has a biodegradability of at least 60% as determined using OECD 301F and wherein the composition is homogeneous at room temperature and has a kinematic viscosity of at least 25 $mm^2$/sec at 40° C.

3. The composition of claim 2 wherein the polyalkylene glycol is an oxyethylene/oxypropylene block copolymer and has a molecular weight of no more than 4000 g/mol as determined by ASTMD4274.

4. The composition of claim 2 wherein the polyalkylene glycol is an oxyethylene/oxypropylene block copolymer having a weight percent of oxyethylene of at least 25% based on total weight of the copolymer.

5. The composition of claim 1 wherein the glycol is selected from ethylene glycol and diethylene glycol.

6. The composition of claim 1 wherein the block copolymer has a triblock structure with two oxyethylene blocks on either side of an oxypropylene block.

7. The composition of claim 1 wherein the weight percent of oxyethylene in the polyalkylene glycol is less than 40%.

8. The composition of claim 1 wherein the water is present in an amount of 30 to 50 weight % and the weight percent of oxyethylene in the polyalkylene glycol is from 25 to 35%.

9. The composition of claim 1 wherein the water is present in an amount from 10 to 30 weight % and the weight percent of oxyethylene in the polyalkylene glycol is from 30 to 40%.

10. The composition of claim 1 wherein the additive comprise one or more additives selected from corrosion inhibitors, friction modifiers, anti-wear additives, air release additives, foam control agents, anti-microbials and dyes.

11. The composition of claim 2 wherein the polyalkylene glycol has the formula

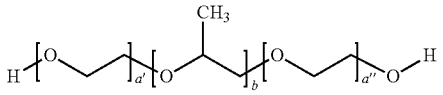

wherein a' and a" are independently in each occurrence an integer of 0 to 20 provided that a'+a" is at least 5 and no more than 40, and b is an integer of from 15 to 40.

12. A method comprising providing the composition of claim 1 as a hydraulic fluid in subsea oil production to control the flow of oil.

13. The composition of claim 2 wherein the glycol is selected from ethylene glycol and diethylene glycol.

14. The composition of claim 2 wherein the polyalkylene glycol is an oxyethylene/oxypropylene block copolymer having a triblock structure with two oxyethylene blocks on either side of an oxypropylene block.

15. The composition of claim 2 wherein the polyalkylene glycol is an oxyethylene/oxypropylene block copolymer having a weight percent of oxyethylene in the polyalkylene glycol less than 40%.

16. The composition of claim 2 wherein the polyalkylene glycol is an oxyethylene/oxypropylene block copolymer, the water is present in an amount of 30 to 50 weight % and the weight percent of oxyethylene in the polyalkylene glycol is from 25 to 35%.

17. The composition of claim 2 wherein the polyalkylene glycol is an oxyethylene/oxypropylene block copolymer, the water is present in an amount from 10 to 30 weight % and the weight percent of oxyethylene in the polyalkylene glycol is from 30 to 40%.

18. The composition of claim 1 wherein the polyalkylene glycol has a biodegradability of at least 90% as determined using OECD301F.

19. The composition of claim 2 wherein the polyalkylene glycol has a biodegradability of at least 90% as determined using OECD301F.

* * * * *